United States Patent [19]

Christen

[11] Patent Number: 4,625,913

[45] Date of Patent: Dec. 2, 1986

[54] SPRINKLER HAVING TWO-PIECE DRIVE ARM BRIDGE

[75] Inventor: Hans D. Christen, La Verne, Calif.

[73] Assignee: Rain Bird Sprinkler Mfg. Corp., Glendora, Calif.

[21] Appl. No.: 624,981

[22] Filed: Jun. 27, 1984

[51] Int. Cl.[4] ..... B05B 3/08; B05B 3/14

[52] U.S. Cl. ..... 239/1; 239/230; 239/233; 239/264

[58] Field of Search ..... 239/1, 222.13, 222.15, 239/222.17, 230–233, 264, 380, 381, 600; 29/157 C; 24/587, 662; 403/331, 381

[56] References Cited

U.S. PATENT DOCUMENTS

| | | | |
|---|---|---|---|
| 2,895,199 | 7/1959 | Jones | 24/662 X |
| 3,091,487 | 5/1963 | Gallagher et al. | 403/381 |
| 3,191,727 | 6/1965 | Schneltz et al. | 24/587 X |
| 3,338,285 | 8/1967 | Jaster | 24/587 X |
| 3,734,551 | 5/1973 | Hughes et al. | 24/662 X |
| 4,033,510 | 7/1977 | Jennison et al. | 239/230 |
| 4,173,306 | 11/1979 | Ridgway | 239/230 |

FOREIGN PATENT DOCUMENTS

| | | | |
|---|---|---|---|
| 1254285 | 11/1971 | United Kingdom | 239/233 |

*Primary Examiner*—Joseph F. Peters, Jr.
*Assistant Examiner*—Mary Beth O. Jones
*Attorney, Agent, or Firm*—Kelly, Bauersfeld & Lowry

[57] ABSTRACT

A sprinkler of the impact drive type is constructed substantially of plastic and includes a separate cap which is snap-fit over a pair of upwardly extending legs from a sprinkler body to form a bridge for an impact mechanism window. Provision of the separate bridge-forming cap facilitates automated assembly of the sprinkler, and also allows protective bearing-surface shields to be formed integrally with other sprinkler components and positioned about critical wear regions of a fulcrum pin for pivotally supporting an impact drive arm. When a plastic fulcrum pin is used, these bearing-surface shields protect the pin from abrasives, such as dirt, which can otherwise become lodged between the pin and the drive arm to cause accelerated pin wear.

17 Claims, 9 Drawing Figures

SPRINKLER HAVING TWO-PIECE DRIVE ARM BRIDGE

BACKGROUND OF THE INVENTION

This invention relates generally to irrigation sprinklers of the impact or reaction drive types, and, more specifically, to an apparatus and method for assembling sprinklers, having plastic pivoting pins protected by integral bearing-surface shields, through an automated process.

Conventional impact drive sprinklers have been manufactured substantially of metals such as brass, and include an impact drive mechanism which pivots about a vertical axis. The drive mechanism typically comprises a counterweighted impact drive arm which is supported on and pivots about a durable stainless steel fulcrum pin, a spring which biases the arm in one rotational direction about the fulcrum pin, and a deflector spoon unit for cyclically interrupting a water stream projected from the sprinkler resulting in a reaction force driving the arm in an opposite rotational direction. Because the pin firmly positions the impact drive mechanism upon a sprinkler main body and provides the pivotal axis therefor, proper placement of the pin is crucial to the correct operation of the sprinkler.

One problem encountered with such prior sprinklers is that manufacturing costs are relatively high in view of the time-consuming and expensive manual labor required to properly assemble the various sprinkler components. More specifically, the impact drive mechanism is normally placed within a sprinkler body window defined by an inverted, generally U-shaped bridge which is integrally formed with a pair of legs extending upwardly from the main body of the sprinkler. The drive arm, the spring and any associated bearing structure must be properly aligned within this window prior to placement of the fulcrum pin for proper sprinkler operation in use. Unfortunately, the closed loop formed by the sprinkler window makes automated sprinkler assembly impracticable, and, as a result, necessitates hand alignment of the drive mechanism components therein.

In recent years, sprinkler manufacturers have produced sprinklers of the impact drive type from molded plastics in an effort to reduce manufacturing costs. Although from a cost standpoint it is generally considered desirable to provide a plastic fulcrum pin for the drive arm pivotal axis in such sprinklers, stainless steel pins are still frequently used because of their proven extended wear characteristics. It has been believed that the bearing surfaces of less expensive plastic fulcrum pins require extra protection from dirt, grit, and the like, for the pins to have adequately long lives. Consequently, when plastic fulcrum pins have been used, protective bearing-surface shields have been provided as additional components to surround any portions of the plastic pins which may be exposed to abrasives while in use.

Efforts to incorporate plastic fulcrum pins and the necessary protective bearing-surface shields into prior sprinklers ahve been frustrated primarily due to assembly difficulties. More specifically, as described in connection with conventional metal sprinklers, proper installation of the impact drive arm within the closed loop sprinkler window still requires costly hand alignment. Moreover, these installation difficulties have generally made it impossible to incorporate bearing-surface shields integrally with any other portion of the spinkler.

Accordingly, there has been a need for an apparatus and a method for assembling durable and reliable impact drive sprinklers through a substantially automated process. To this end, an improved sprinkler must eliminate the previous requirement that the impact drive mechanism be hand aligned within the sprinkler window prior to placement of the fulcrum pin. Further, when a plastic fulcrum pin is utilized, protective bearing-surface shields must be provided in an economical manner without disturbing the capability of the improved sprinkler to be assembled during an automated manufacturing process. The present invention fulfills these needs and provides other related advantages.

SUMMARY OF THE INVENTION

The present invention resides in an improved sprinkler, particularly of the impact drive type, which can be efficiently assembled utilizing inexpensive plastic components during an automated process to form a highly durable apparatus. The improved sprinkler comprises generally a main body having a pair of upwardly extending legs which combine with a separate bridge-forming cap to define a sprinkler window. An impact drive mechanism, including an impact drive arm and a spring, is positioned within the window by a fulcrum pin and functions in a known manner to rotate the sprinkler in steps about a generally vertical axis in response to interaction between the drive arm and a water discharge stream exiting the main body.

In one preferred form, a plastic fulcrum pin, which is separate from the bridge-forming cap and the sprinkler main body, is utilized to provide a vertical pivotal axis for the impact drive mechanism. The impact drive mechanism can be assembled onto the sprinkler main body through an automated manufacturing process which includes the steps of pivotally positioning the impact drive arm and the spring over the pin, and positioning that plastic pin on a main body base ridge. After the impact drive mechanism and the pin have been positioned on the sprinkler main body, the bridge-forming cap is securely snap-fit onto the upwardly extending legs in a manner holding the impact drive mechanism and pin subassembly inescapably in place.

To help isolate the plastic fulcrum pin from abrasives and, consequently, extend its useful life, the improved sprinkler includes a plurality of protective bearing-surface shields. The impact drive arm has an integral bearing-surface shield formed about its lower end which circumferentially surrounds the lower end of the fulcrum pin. This lower shield tends to prevent the entrance of dirt and other abrasive substances between the lower interfacing bearing surfaces of the pin and the drive arm. Further, the bridge-forming cap also includes an integral bearing-surface shield which circumferentially surrounds both an upper portion of the fulcrum pin and an upper portion of the drive arm. Like the lower shield, this upper shield tends to prevent the entrance of dirt and other abrasive substances between the upper interfacing bearing surfaces of the pin and the drive arm.

In another preferred form, the components of the improved sprinkler, and their respective functions, are virtually identical to those described in connection with the first embodiment, with the exception that the plastic fulcrum pin is provided as an integral component with other portions of the sprinkler, such as being integrally formed with the cap. Such a configuration is advantageous because the assembly step of positioning the pin on the main body base ridge prior to snap-fitting the cap to the upwardly extending legs, is eliminated. Further, the cap with the integral pin can be pre-assembled with the impact drive mechanism to make attachment of a cap subassembly to the sprinkler main body the sole assembly step. Moreover, bearing-surface shields are provided as described above with the exception that the lower shield circumferentially surrounds a main body pin retaining well rather than the base of the pin.

In both preferred forms, the fulcrum pin is formed of a molded plastic material, such as a wear resistant nylon sold under the trademark ZYTEL by E. I. Du Pont de Nemours and Company, or the like, to attain the desired durability and long life. On the other hand, the bridge-forming cap, the sprinkler main body and the impact drive arm are preferably formed of a less expensive and stronger glass-filled plastic. However, should the pin be integrally formed with the bridgeforming cap, as set forth in the second preferred embodiment, the entire cap and pin component can be formed of the molded plastic material without glass fill to provide the pin with the desired wear characteristics.

Other features and advantages of the present invention will become apparent from the following more detailed description, taken in conjunction with the accompanying drawings while illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
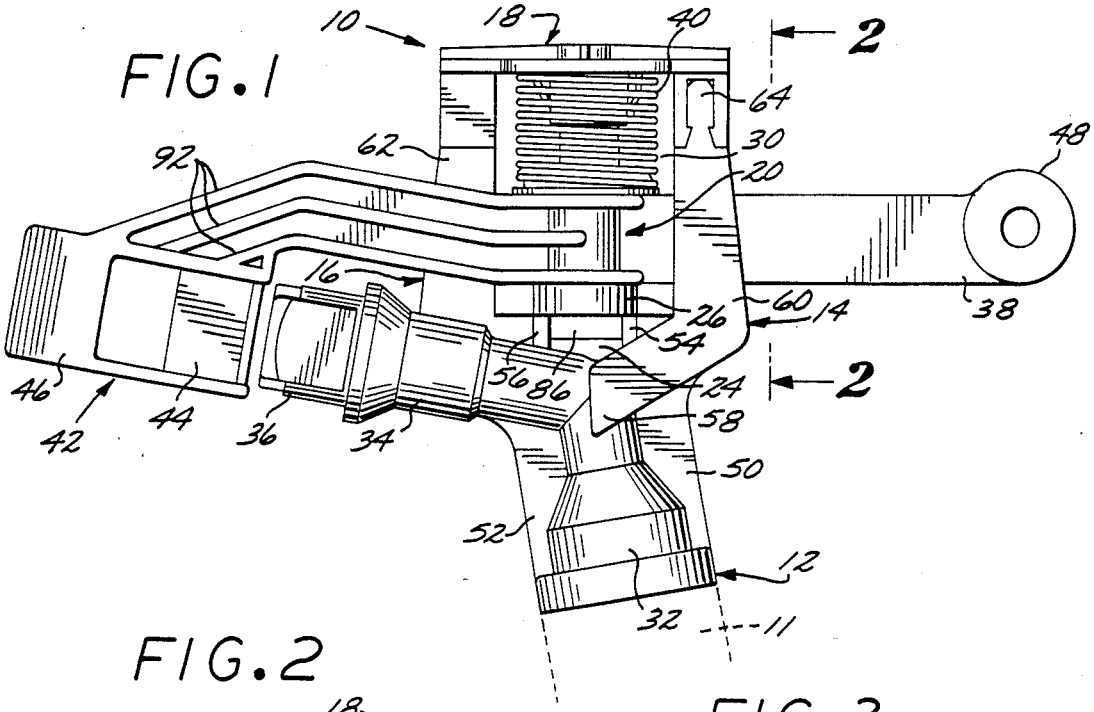
FIG. 1 is a side elevational view of an improved sprinkler having a two-piece impact arm bridge embodying the novel features of the invention.
Figure 2:
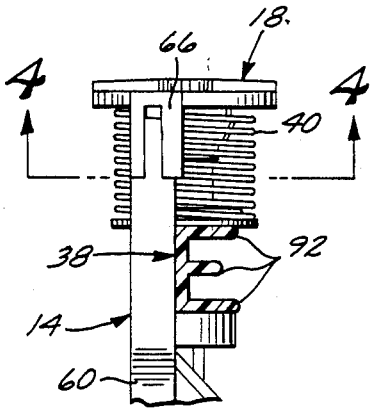
FIG. 2 is a fragmented, vertical sectional view taken generally along the line 2—2 of FIG. 1.
Figure 3:
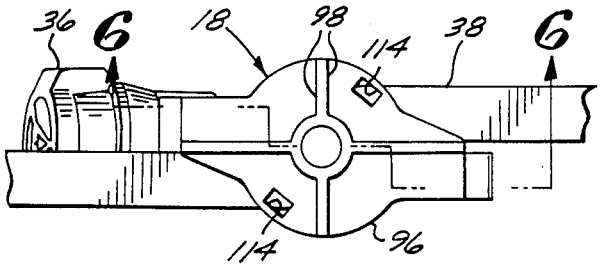
FIG. 3 is a fragmented top plan view of the improved sprinkler illustrated in FIG. 1.

As shown in the drawings for purposes of illustration, the present invention is embodied in an improved sprinkler of the impact drive type, generally designated by the reference number 10, which can be efficiently assembled preferably by an automated process to form a highly durable and reliable apparatus. The improved sprinkler 10 comprises generally a main body 12 having a pair of upwardly extending legs 14 and 16 which combine with a separate bridge-forming cap 18 to pivotally position an impact drive mechanism 20.

In one preferred form, a plastic fulcrum pin 22, which is separate from the bridge-forming cap 18 and the sprinkler main body 12, is seated on a main body base ridge 24 to support the impact drive mechanism 20 and provide it a vertical pivotal axis. Subsequently, the cap 18 is snap-fit onto the upwardly extending legs 14 and 16 in a manner holding the drive mechanism 20 and the pin 22 inescapably in place. In another preferred form, the plastic fulcrum pin 22 is integrally attached to the bridge-forming cap 18. With this latter embodiment, the assembly step of positioning the pin 22 on the sprinkler main body 12 prior to attaching the cap 18 to the upwardly extending legs 14 and 16 is eliminated since both tasks are accomplished simultaneously. In both preferred forms, protective bearing-surface shields 26 and 28 are provided to help isolate the plastic pin 22 from abrasives which could otherwise lodge between the pin and the impact drive mechanism 20, and undesirably reduce the useful life of the pin.

The improved sprinkler 10 of the present invention can be assembled through a substantially automated process because the previous requirement that the impact drive mechanism be hand-aligned prior to placement of the fulcrum pin has been eliminated. Such automated assembly significantly reduces the cost of manufacturing the improved sprinkler 10, and yet does not appreciably or negatively affect the quality or operation of the finished product. When a plastic fulcrum pin is utilized, protective bearing-surface shields can be conveniently included without adversely affecting the ease with which the sprinkler can be automatically assembled. Moreover, after the bridge-forming cap 18 is snap-fit over the upwardly extending legs 14 and 16 of the main body 12, the impact drive mechanism 20 is inescapably held in a pivoting relationship about the fulcrum pin 22 and within a sprinkler window 30 defined by the main body and the cap.

As is the case with conventional impact drive sprinklers, the improved sprinkler 10 is adapted for rotatable mounting about a vertical axis on a water supply pipe or riser (not shown) by means of a rotatable bearing portion 11 of any suitable design and illustrated in FIG. 1 by dotted lines. The sprinkler body 12 of the improved sprinkler 10 is connected to this lower bearing portion 11 by a lower inlet portion 32. Extending upwardly and outwardly from the inlet portion 32 of the body 12 is a discharge tube 34. When in use, water is admitted under supply pressure into the improved sprinkler 10 through the riser and the bearing portion 11, and travels through an internal conduit (not shown) in the main body 12 and through the discharge tube 34 to a removable spray nozzle 36. The nozzle 36 ejects the water upwardly and outwardly away from the improved sprinkler 10, the distance of throw being a function of sprinkler and nozzle size, and the supply pressure of the water admitted into the sprinkler.

To drive the improved sprinkler 10, an impact drive arm 38 is pivotally mounted about a vertical axis provided by the fulcrum pin 22. The arm 38 is biased by a spring 40 to the position shown in FIG. 1, and includes a deflector spoon unit 42 having an inner water deflecting vane 44 and an outer water deflecting spoon 46 disposed at one end of the arm. A counter-weight 48 is situated at the end of the impact drive arm 38 opposite the spoon unit 42. The spring 40 and the impact arm 38 generally form that portion of the improved sprinkler 10 referred to as the impact drive mechanism 20.

The operation of the impact drive mechanism 20 to drive the improved sprinkler 10 is well known in the art, and it is not believed necessary to describe that operation in detail here. It is sufficient for the purposes of this invention to point out that during the operation of the improved sprinkler 10, the inner vane 44 and the outer spoon 46 of the drive arm 38 are urged by the spring 40 to intermittently enter the stream of water emitted from the nozzle 36, causing the drive arm to impact against one or both of the upwardly extending legs 14 and 16 of the body 12, thereby imparting to the improved sprinkler an increment of rotational movement about the supply riser. After such impact, interaction between the water stream and the outer spoon 46 forces the drive arm 38 to rotate back out of the stream, wherein this reversed rotation is ultimately reversed again by the spring 40 to return the drive arm for a subsequent impact with the sprinkler body 12.

In accordance with the present invention, and with reference to FIGS. 1 through 8, the sprinkler main body 12 is constructed preferably of a glass-filled plastic such as polypropylene, which is generally cheaper and stronger than unfilled polypropylene. It is preferable that a plastic having about 20% glass fill be utilized. To lend sufficient rigidity to the lower inlet portion 32 and the discharge tube 34, a pair of body ribs 50 and 52 are molded into the main body 12. Further, to provide a support base for the pin 22, and also to increase the over-all rigidity of the main body 12, a third rib in the form of the base ridge 24 is provided over the junction between the lower inlet portion 32 and the discharge tube 34, and between the two upwardly extending legs 14 and 16. This base ridge 24 includes a pair of integral parallel, laterally projecting, spacers 54 and 56 on each side (FIG. 8) which center the fulcrum pin 22 in a manner to be more fully described hereinafter.

The upwardly extending legs 14 and 16 are integrally formed with the main body 12, and are reinforced to withstand the stresses which are applied during use of the improved sprinkler 10. As best shown in FIG. 1, the first leg 14 includes a lower reinforced portion 58 which is supported by the first body rib 50, the base ridge 24, and the junction between the lower inlet portion 32 and the discharge tube 34. Extending upwardly from the lower reinforced portion 58 is an upper reinforced pillar 60. The second leg 16 simply has a second upper reinforced pillar 62 supported by the discharge tube 34 and the base ridge 24.

Figure 4:
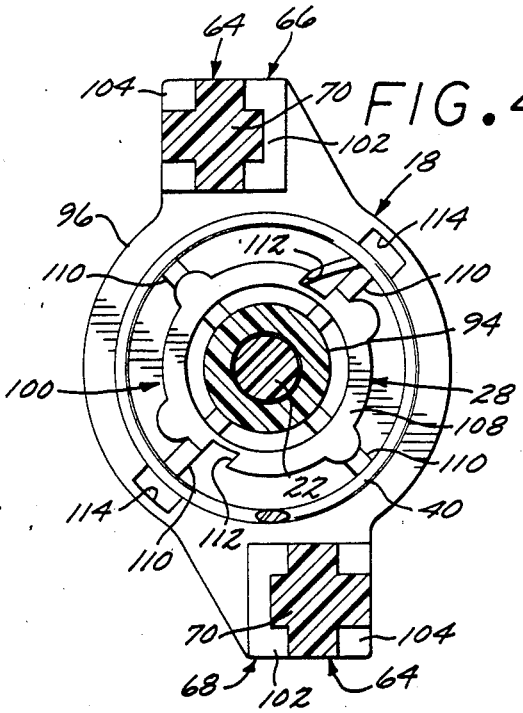
FIG. 4 is an enlarged, horizontal sectional view taken generally along the line 4—4 of FIG. 2, illustrating the relationship between a bridge-forming cap which is snap-fit over a pair of upwardly extending legs from the sprinkler main body, a plastic fulcrum pin, and an impact drive arm pivotally mounted on the pin within a sprinkler window between the cap and the main body.
Figure 5:
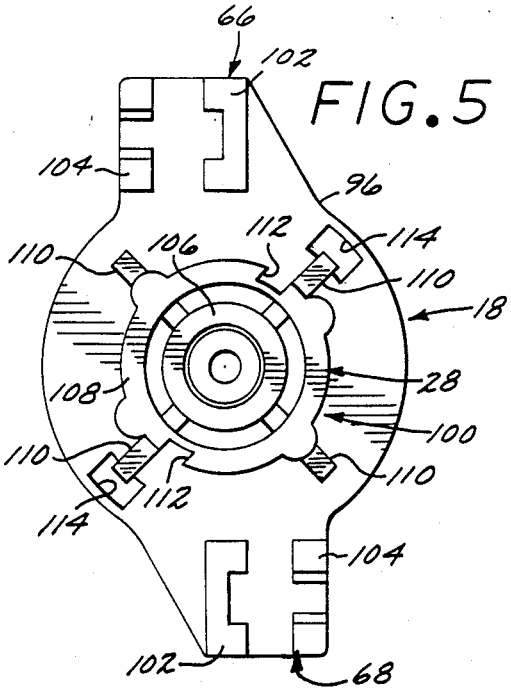
FIG. 5 is a view similar to that shown in FIG. 4, illustrating the details of the bridge-forming cap when removed from the upwardly extending legs, the pin, and the drive arm.
Figure 6:
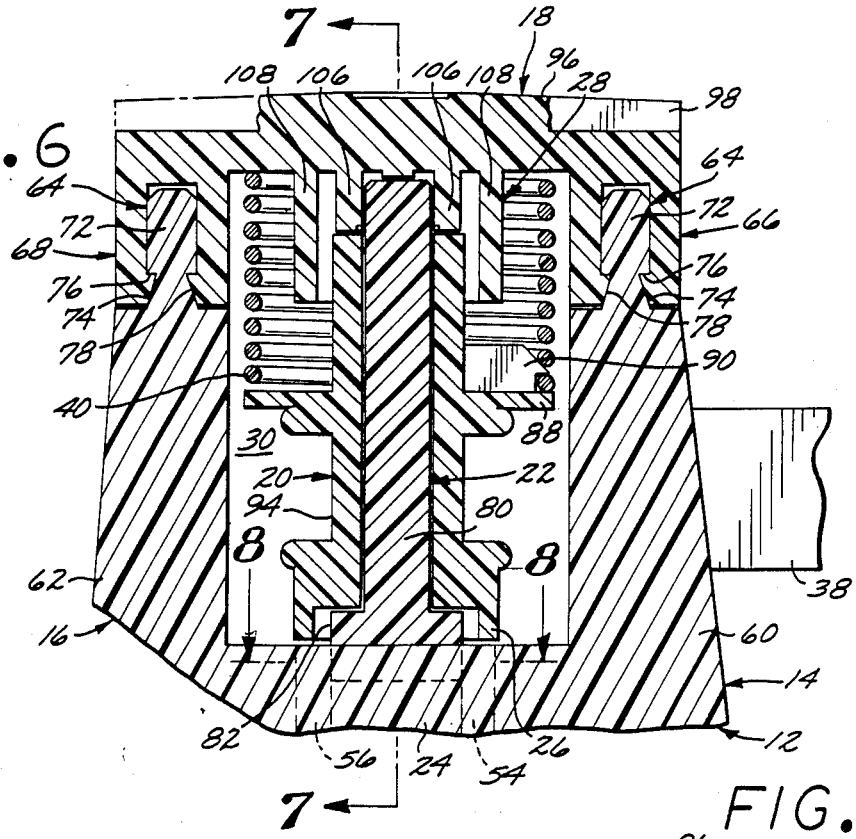
FIG. 6 is an enlarged, fragmented, vertical sectional view taken generally along the line 6—6 of FIG. 3, illustrating the positioning of an impact drive mechanism upon the fulcrum pin within the sprinkler window.

Each of the upwardly extending legs 14 and 16 is capped by a locking stud 64 which cooperates with a pair of complementary clasps 66 and 68 descending downwardly from the bridge-forming cap 18. As best illustrated in FIGS. 4 and 6, the locking studs 64 are identical to one another except that they are oppositely facing. These studs 64 include a cross sectionally T-shaped support and guide structure 70 which has an integrally formed locking head 72. The locking heads 72 are connected to the upper reinforced pillars 60 and 62 by tapered necks 74. At the base of each head 72 is a downwardly presented shoulder 76 which can be securely grasped by clasp teeth 78 at the lower ends of the clasps 66 and 68 to prevent separation of the cap 18 form the main body 12 when mated.

The fulcrum pin 22 is preferably constructed of an unfilled molded plastic material, such as a wear resistant nylon sold under the trademark ZYTEL by E. I. Du Pont de Nemours and Company, to provide acceptable strength characteristics and to minimize frictional wear on the bearing surface of the pin. However, a glassfilled pin could be used particularly in conjunction with an impact drive mechanism constructed substantially of an unfilled molded plastic material, such as polypropylene.

Figure 8:
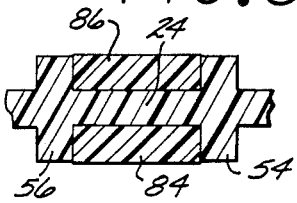
FIG. 8 is a fragmented, horizontal sectional view taken generally along the line 8—8 of FIG. 6.
Figure 7:
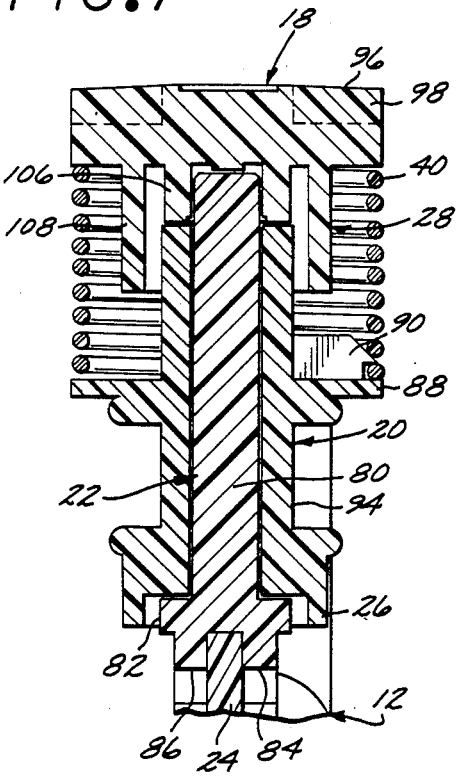
FIG. 7 is a fragmented, vertical sectional view taken generally along the line 7—7 of FIG. 6.

As illustrated in FIGS. 6 through 8, the fulcrum pin 22 includes an elongated shaft 80 having a circular base flange 82 at its lower end. Below the base flange 82 are two parallel supports 84 and 86 which can be placed over the base ridge 24 between the integral parallel spacers 54 and 56 to position the pin 22 on the sprinkler main body 12. These spacers 54 and 56 serve to substantially center the pin 22 on the main body 12 between the upwardly extending legs 14 and 16.

After the pin 22 has been placed on the main body 12, the impact drive mechanism 20 can be pivotally positioned over the pin, if not already so positioned prior to the seating of the pin on the base ridge 24. As described previously, the impact drive mechanism 20 includes, generally, the impact drive arm 38 and the biasing spring 40. The spring 40 rests on an upper circular flange 88 of the drive arm 38, and has a lower end rigidly positioned on the arm by a plurality of spacer blocks 90 integrally formed with the arm. The upper end of the spring 40 is similarly rigidly attached to the cap 18 after it is mated to the main body 12. The net effect of so attaching both ends of the spring 40 is to bias the rotational positioning of the arm 38, with respect to the main body 12, to the position shown in FIG. 1.

The impact drive arm 38 includes a plurality of reinforcing ridges 92 which increase the strength and rigidity of the arm without needlessly increasing its weight or cost. On one side of the arm 38, these reinforcing ridges 92 extend from the deflector spoon unit 42 to a cylindrical spool 94 surrounding a portion of the pin 22. On the other side of the arm 38, these reinforcing ridges 92 extend from the cylindrical spool 94 to the counterweight 48.

A tubular channel is included within the cylindrical spool 94 of the impact drive arm 38 where the pin 22 is positioned when assembling the arm to the pin. The interfacing surfaces between the pin 22 and the arm 38 are, effectively, bearing surfaces. Because the pin 22 is constructed preferably of a molded plastic material, it is necessary to minimize the chance that dirt and similar abrasive substances will become lodged between these bearing surfaces and cause excessive wear upon the pin.

To protect the pin 22 from such abrasives, the impact drive arm 38 provides a bearing-surface shield 26 at its lower end which circumferentially surrounds the base flange 82 of the pin 22. This lower shield 26 is simply a cylindrical shell which descends downwardly from the spool 94 to substantially cover the outer radial surface of the base flange 82. The purpose of this lower shield 26 is to reduce the amount of grit or the like, which can be become lodged between the interfacing surfaces of the pin 22 and the arm 38. Similarly, an upper bearing-surface shield 28 is provided on the underside of the bridge-forming cap 18 near the upper end of the pin 22.

The separate bridge-forming cap 18 is the component of the improved sprinkler 10 which facilitates automated assembly of the impact drive mechanism 20 and the fulcrum pin 22 onto the main body 12, and which securely holds the impact drive mechanism and pin in place within the sprinkler window 30 defined by the base ridge 24, the cap, and the two upwardly extending legs 14 and 16. The bridge-forming cap 18 is preferably constructed of a glass-filled plastic similar to that used in the main body 12. The cap 18 generally comprises a hood 96 having reinforcing ridges 98 on its top side, the pair of downwardly descending clasps 66 and 68 on its bottom side which interact with the locking studs 64 of the upwardly extending legs 14 and 15, and a pin guide and shield structure 100 on its bottom side between the clasps.

After the impact drive mechanism 20 and the fulcrum pin 22 are properly positioned on the main body 12, the cap 18 is simply aligned over the pin, the impact drive mechanism and the upwardly extending legs 14 and 16, and then irreversably snap-fit into place over the locking studs 64. The clasps 66 and 68 each have a backing member 102 and a gripping member 104 which act to rigidly grasp the locking studs 64. Each gripping member 104 includes the clasp teeth 78 which are configured to match the shape of the tapered neck 74 and shoulder 76 of the locking heads 72. These clasp teeth 78 are resiliently biased to snap into place between the tapered neck 74 and the shoulder 76 of the locking heads 72 after being slightly deformed when passing downwardly into place.

The pin guide and shield structure 100 integrally formed with the cap 18 includes two concentric cylindrical shells 106 and 108 having unequal lengths, and four spring guides 110. The upper end of the spring 40 is sharply bent around one of the spring guides 110 and placed in a retaining slot 112 (FIG. 4). A pair of oppositely situated retaining slots 112 are provided within the outer wall of the outer cylindrical shell 108 for this purpose. Further, to facilitate access to the upper end of the spring 40, a rectangular aperture 114 is provided through the hood 96 near each retaining slot 112.

The inner cylindrical shell 106 provides an anchor for the upper end of the fulcrum pin 22 by preventing any lateral or longitudinal movement of the pin after the cap 18 is snap-fit onto the main body 12. The outer cylindrical shell 108 descends downwardly beyond the interfacing surfaces between the impact arm spool 94 and the inner shell 106, to provide the protective upper bearing-surface shield 28. This upper shield 28 is basically the same as the lower shield 26 in that it is intended to prevent dirt or the like, from lodging between the interfacing bearing surfaces of the pin 22 and impact drive arm 38.

The separate cap 18 provides the improved sprinkler 10 with a two-piece bridge, one piece being defined by the sprinkler main body 12 and the other being defined by the cap, which can be advantageously combined an automated assembly process to reduce or eliminate the hand-alignment of the impact drive mechanism 20 often necessary with prior sprinklers. With the bridge-forming cap 18 removed, the impact drive mechanism 20 and the fulcrum pin 22 can be positioned on the main body 12 in a quick and economical manner. Further, the provision of the separately installed cap 18 facilitates the inclusion of the integral bearing surface shields 26 and 28, and allows the plastic pin 22 to be used.

Figure 9:
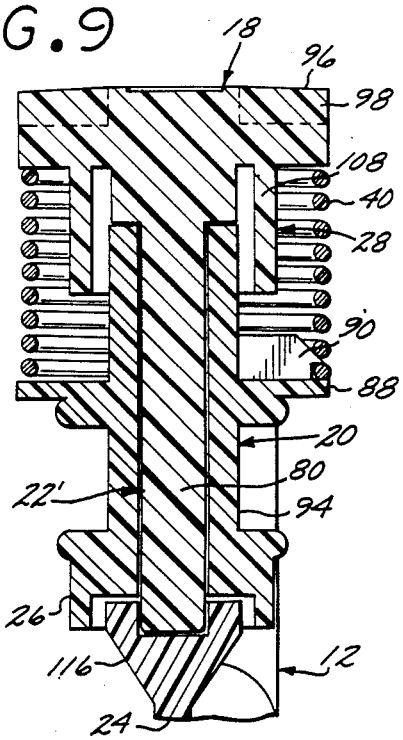
FIG. 9 is a fragmented sectional view similar to that shown in FIG. 7, illustrating an alternative embodiment of the invention having the fulcrum pin integrally formed with the cap.

It should be apparent, however, that the relationships between the improved sprinkler components can be varied to suit various intended purposes. For example, as illustrated in FIG. 9, a modified fulcrum pin 22' can be integrally formed with the cap 18. In this case, all of the improved sprinkler components would function as described above with a minor modification being necessary to the lower end of the pin 22'. In particular, rather than providing the pin 22' with the base flange 82 and the pair of channel-forming supports 84 and 86, the main body 12 of the sprinkler would be expanded above the base ridge 24 to form a pin retaining well 116 which would anchor the lower portion of the integral pin.

In this alternate embodiment, the upper and lower bearing-surface shields 26 and 28 are still provided to prolong the effective life of the pin 22'. Further, as was the case in the first embodiment, it is preferred that the pin 22' be formed of a molded unfilled plastic material, such as polypropylene. To accommodate this feature, the entire cap 18 would also be formed of unfilled plastic. This change would not negatively affect the uses possible with the alternate improved sprinkler 10 as compared to the version having the separate fulcrum pin 22.

Moreover, integrally attaching the pin 22' to the cap 18 presents a manufacturer of the improved sprinkler 10 unique automated assembly opportunities. On one hand, the manufacturer may desire to pre-assemble the impact drive mechanism 20 to the integral cap 18 and pin 22' combination, and subsequently attach that sub-assembly to the sprinkler main body 12 as a unit. On the other hand, the various components of the impact drive mechanism 20 could be aligned adjacent the main body 12, and the attachment of the cap 18 and pin 22' combination would complete the assembly of the impact drive mechanism and the sprinkler 10 simultaneously during a single attaching step.

Although two particular embodiments of the invention have been described in detail for purposes of illustration, various modifications of each may be made without departing from the spirit and scope of the invention. For example, rather than being integrally formed with the cap 18 as shown in FIG. 9, the fulcrum pin can be integrally formed with the sprinkler main body 12. Further, neither the sprinkler main body 12 nor the cap 18 need to be formed of a plastic material, but can be manufactured of a conventional sprinkler metal, such as brass. Moreover, an integral cap 18 and pin 22' combination formed of a plastic material can be advantageously assembled during an automated manufacturing process to a sprinkler main body formed of a conventional sprinkler metal. Accordingly, the invention is not to be limited, except as by the appended claims.

I claim:

1. An improved sprinkler, comprising:

a main body having a pair of upwardly extending legs which each terminate in a locking stud;

an impact drive mechanism having an impact drive arm and a spring, said drive arm pivoting about a vertical axis in response to a rotational biasing of said spring and interaction between said drive arm and a fluid stream exiting said main body;

means for pivotally mounting said impact drive mechanism on said body, said mounting means including a fulcrum pin independently positionable on said main body, and having a bearing surface which interfaces with an oppositely facing bearing surface of said drive arm;

a bridge-forming cap including a hood and a pair of downwardly descending clasps which each snap-fit over a corresponding one of said locking studs, said cap providing a guide for the upper portion of said mounting means; and means for shielding the interfacing bearing surfaces of said mounting means and said drive arm against entry of abrasives.

2. A sprinkler as set forth in claim 1 wherein said main body is constructed of a plastic material.

3. A sprinker as set forth in claim 1 wherein said mounting means is constructed of a plastic material.

4. A sprinkler as set forth in claim 1 wherein said bridge-forming cap is constructed of a plastic material.

5. A sprinkler as set forth in claim 1 wherein said mounting means and said bridge-forming cap are an integral unit.

6. A sprinkler as set forth in claim 1 wherein said shielding means includes an upper bearing-surface shield and a lower bearing-surface shield.

7. A sprinkler as set forth in claim 6 wherein said upper shield is integrally formed with said bridge-forming cap to circumferentially surround an upper gap through which abrasives can travel to become lodged between the interfacing bearing surfaces of said mounting means and said drive arm.

8. A sprinkler as set forth in claim 6 wherein said lower shield is integrally formed with said drive arm to circumferentially surround a lower gap through which abrasives can travel to become lodged between the interfacing bearing surfaces of said mounting means and said drive arm.

9. A sprinkler as set forth in claim 1 wherein said upwardly extending legs each include a locking head having a tapered neck and shoulder, said locking heads being inescapably gripped by said clasps, each clasp comprising a clamp having a pair of clasp teeth for gripping said shoulder.

10. A sprinkler as set forth in claim 1 wherein said shielding means includes:

an upper shield integrally formed with said bridge-forming cap to circumferentially surround an upper gap through which abrasives can travel to become lodged between the interfacing bearing surfaces of said mounting means and said drive arm; and a lower shield integrally formed with said drive arm to circumferentially surround a lower gap through which abrasives can travel to become lodged between the interfacing bearing surfaces of said mounting means and said drive arm.

11. A method of assembling an improved sprinkler, the steps comprising:

providing a main body having a pair of upwardly extending legs which each terminate in a first locking member, the main body providing a principle fluid conduit for the improved sprinkler;

assembling an impact drive mechanism having an impact drive arm and a spring for biasing the rotational movement of the drive arm, to means for pivotally mounting the impact drive mechanism, thereby creating a subassembly;

placing the subassembly on the main body; and inescapably securing the subassembly to the main body by locking a bridge-forming cap having a pair of downwardly descending second locking members to the main body, the second locking members being engaged with the first locking members on the legs.

12. A method as set forth in claim 11 wherein said step of inescapably securing the subassembly to the main body includes simultaneously placing the subassembly on the main body.

13. A method as set forth in claim 12 wherein said step of assembling the impact drive mechanism to the mounting means to create the subassembly is conducted in connection with the bridge-forming cap which is integrally formed with the mounting means.

14. A method as set forth in claim 11 including the step of shielding interfacing bearing surfaces between the mounting means and the impact drive arm.

15. An improved sprinkler, comprising:

a main body having a base ridge horizontally disposed between a pair of vertically upwardly extending legs which each terminate in a locking stud;

an impact drive mechanism having an impact drive arm and a spring, said drive arm pivoting about a vertical axis situated between said legs in response to a rotational biasing of said spring and interaction between said drive arm and a fluid stream exiting said main body;

a separate fulcrum pin which provides the pivotal axis for said drive arm, said pin having a bearing surface which interfaces with an oppositely facing bearing surface of said drive arm, and two laterally spaced parallel supports at its lower end which are placed over said base ridge to position said pin on said main body; and a bridge-forming cap having a hood which supports a pair of downwardly descending clasps and a pin guide and shield structure, said clasps each fitting over a corresponding one of said locking studs to connect said cap to said main body, and said structure forming a well which receives the upper portion of said pin to prevent its lateral or longitudinal movement, said pin being inescapably positioned between said main body and said cap after said clasps are fitted over said locking studs.

16. A sprinkler as set forth in claim 15 further including:

an upper bearing-surface shield integrally formed with said cap as part of said pin guide and shield structure, said upper shield circumferentially surrounding the interfacing surfaces between said cap and said drive arm to shield the interfacing bearing surfaces of said pin and drive arm against entry of abrasives; and a lower bearing-surface shield integrally formed with said drive arm, said lower shield circumferentially surrounding a lower interfacing surface between said drive arm and said pin to shield the interfacing bearing surfaces of said pin and said drive arm against entry of abrasives.

17. An improved sprinkler, comprising:

a main body having a pin retaining well disposed between a pair of vertically upwardly extending legs which each terminate in a locking stud;

an impact drive mechanism having an impact drive arm and a spring, said drive arm pivoting about a vertical axis situated between said legs in response to a rotational biasing of said spring and interaction between said drive arm and a fluid stream exiting said main body;

a bridge-forming cap having a hood which supports a pair of downwardly descending clasps and an integral fulcrum pin which provides the pivotal axis for said drive arm, said clasps each fitting over a corresponding one of said locking studs to connect said cap to said main body, the lower end of said integral pin being received within said pin retaining well to inescapably position said impact drive mechanism between said cap and said main body;

an upper bearing-surface shield integrally formed with said cap to circumferentially surround an upper interfacing surface between said cap and said drive arm to shield the interfacing bearing surfaces of said pin and drive arm against entry of abrasives; and a lower bearing-surface shield integrally formed with said drive arm, said lower shield circumferentially surrounding the interfacing surfaces between said drive arm and said pin retaining well to shield the interfacing bearing surfaces of said pin and said drive arm against entry of abrasives.

* * * * *

UNITED STATES PATENT AND TRADEMARK OFFICE

CERTIFICATE OF CORRECTION

PATENT NO. : 4,625,913

DATED : December 2, 1986

INVENTOR(S) : Hans D. Christen

It is certified that error appears in the above-identified patent and that said Letters Patent is hereby corrected as shown below:

In Column 1, line 63, please delete the word "ahve" and insert therefor --have--.

In Column 7, line 11, please delete the number "15" and insert therefor --16--.

In Column 7, line 55, after the word "combined" please insert the word --during--.

Signed and Sealed this

Third Day of March, 1987

*Attest:*

DONALD J. QUIGG

*Attesting Officer*

*Commissioner of Patents and Trademarks*